US006910488B2

(12) United States Patent
McConnell et al.

(10) Patent No.: US 6,910,488 B2
(45) Date of Patent: Jun. 28, 2005

(54) VALVE DISHWASHER BASKET AND SOAKING CONTAINER

(75) Inventors: Thomas E. McConnell, Santa Ynez, CA (US); Francois Hacquard, Los Angeles, CA (US); Michael E. Henley, Santa Ynez, CA (US)

(73) Assignee: Prince Lionheart, Inc., Santa Maria, CA (US)

( * ) Notice: Subject to any disclaimer, the term of this patent is extended or adjusted under 35 U.S.C. 154(b) by 203 days.

(21) Appl. No.: 10/246,861

(22) Filed: Sep. 19, 2002

(65) Prior Publication Data

US 2003/0205260 A1 Nov. 6, 2003

Related U.S. Application Data

(63) Continuation-in-part of application No. 10/136,520, filed on May 1, 2002.

(51) Int. Cl.[7] ..... B08B 3/02

(52) U.S. Cl. ..... 134/135; 134/166 R; 134/201; 211/41.8

(58) Field of Search ..... 134/135, 166 R, 134/201, 901; 211/181.1, 89.01; 220/912

(56) References Cited

U.S. PATENT DOCUMENTS

| | | | | |
|---|---|---|---|---|
| 612,625 A | | 10/1898 | Decker | |
| 808,824 A | | 1/1906 | Eick | |
| 843,826 A | | 2/1907 | Kloeppinger | |
| 1,292,935 A | | 1/1919 | Walsh | |
| 1,496,957 A | | 6/1924 | Walker | |
| 1,527,326 A | | 2/1925 | Owens | |
| 1,608,283 A | | 11/1926 | Woosley | |
| 1,618,622 A | | 2/1927 | Woosley | |
| 2,152,456 A | | 3/1939 | Barrie | |
| 2,183,862 A | * | 6/1939 | Wing | 134/137 |
| 2,367,448 A | | 1/1945 | Thiele | |
| 2,586,005 A | | 2/1952 | Colonna | |
| 2,721,567 A | * | 10/1955 | Tierney | 134/158 |
| 2,741,392 A | | 4/1956 | Weiss | |
| 2,936,898 A | | 5/1960 | Miguez | |
| 3,050,073 A | | 8/1962 | McMillan | |
| 3,182,854 A | | 5/1965 | Geller | |
| 3,265,078 A | * | 8/1966 | Gordon | 134/166 R |
| 3,289,854 A | | 12/1966 | Kauffman | |
| 3,935,958 A | * | 2/1976 | Frangos | 220/488 |
| 3,960,290 A | | 6/1976 | Yake et al. | |
| 4,058,233 A | * | 11/1977 | Frangos | 220/488 |

(Continued)

FOREIGN PATENT DOCUMENTS

| | | | |
|---|---|---|---|
| DE | 29 29 227 B1 | | 10/1980 |
| DE | 36 33 046 | * | 1/1988 |
| DE | 296 00 642 | * | 6/1997 |
| DE | 297 01 078 | * | 7/1998 |
| FR | 2 643 809 | * | 9/1990 |
| GB | 85 25 574 | | 12/1985 |
| JP | 16 42 159 | | 8/1971 |
| JP | 11-318608 | * | 11/1999 |

*Primary Examiner*—Frankie L. Stinson
(74) *Attorney, Agent, or Firm*—Stetina Brunda Garred & Brucker

(57) ABSTRACT

A dishwasher basket for storing at least one valve of toddler training cups in a dishwasher for cleaning. The dishwasher basket is assembled by a top shell and a bottom shell. The dishwasher basket is attached to a top rack of the dishwasher by a basket attachment right above the water jet source, such that cleaning effect is enhanced by the pressure generated by the water jet. In another aspect, a soaking container is disclosed, suitable for soaking the dishwasher basket and its contents. The soaking container has a suction cup affixed to its bottom to thereby anchor the container to a counter top or similar surface. Also, the soaking container has a lid to prevent foreign material from falling into the soaking solution and to limit spillage of the soaking solution. The soaking container advantageously facilitates cleaning of the valves.

4 Claims, 4 Drawing Sheets

U.S. PATENT DOCUMENTS 4,157,145 A 6/1979 Jordan
4,192,432 A 3/1980 Jordan
4,193,588 A 3/1980 Doneaux
4,339,051 A 7/1982 Crawford
4,498,594 A 2/1985 Elder
4,512,489 A 4/1985 Green et al.
4,732,291 A 3/1988 McConnell
4,748,993 A 6/1988 Llewellyn
4,830,200 A 5/1989 Zambano et al.
4,836,392 A * 6/1989 Constantino ..... 211/133.5
5,211,191 A * 5/1993 Brown ..... 134/201
D338,749 S 8/1993 McConnell
5,876,513 A * 3/1999 Frankson ..... 134/25.1
5,906,216 A * 5/1999 Barlet ..... 134/58 R
6,371,642 B1 * 4/2002 Nelson et al. ..... 383/23
6,390,104 B1 * 5/2002 Gagnon ..... 134/107
6,705,333 B1 * 3/2004 Pourcho ..... 134/135
6,814,091 B2 * 11/2004 McConnell et al. ..... 134/134

* cited by examiner

VALVE DISHWASHER BASKET AND SOAKING CONTAINER

CROSS-REFERENCE TO RELATED APPLICATIONS

This application is a continuation-in-part of application Ser. No. 10/136,520, filed May 1, 2002, which is incorporated herein in its entirety.

STATEMENT RE: FEDERALLY SPONSORED RESEARCH/DEVELOPMENT (Not Applicable)

BACKGROUND OF THE INVENTION

The present invention relates generally to a storage container, and more particularly, to a basket for storing valves of toddler training cups, suitable for use in a dishwasher.

As most children go through a stage of throwing or dropping their cups constantly, spillproof training cups are commonly used for children to learn the proper way of drinking from a cup. As shown in FIG. 1, a typical spillproof training cup, also referred as the sippy cup, comprises a hollow cup 10 to contain liquid, a lid 12 with a spout 14 allowing children to sip the liquid contained in the hollow cup 10, and a valve 16 attached underneath the lip 12 to make the training cup spillproof. The valve 16 is normally made of plastic or silicone, and is difficult to clean due to its shape and structure. Small scrub brushes can be used for hand washing the valve; however, this is very laborious. The valve can also be placed in a dishwasher for cleaning. But the conventional container or rack is inadequate to simultaneously hold the valve of a toddler training cup, while exposing it for proper cleaning in a dishwasher.

Therefore a substantial need in the art exists to provide a container that can hold the valves in a certain position in a dishwasher, to achieve proper and thorough cleaning of the same. Preferably, such a container exposes the valves to dishwasher cleaning sprays from a multitude of orientations to provide increased cleaning of the valves.

Furthermore, dirty valves often remain unclean for hours at a time before they can be ultimately cleansed in the dishwasher. Residual liquids on the valve, such as milk or juice, typically dry out before the valve is properly cleaned. Once dried out, the residual liquid leaves a deposit caked onto the valve, thereby making the task of cleaning the valve more difficult. If dirty valves are soaked in a liquid before they are cleaned, such residual fluid would not have an opportunity to dry out. Likewise, soaking tends to dissolve deposits that have previously formed on the valves, thereby ensuring that the valves are cleaner before they enter the dishwasher. Therefore, there is a need for a container within which a toddler cup valve dishwasher basket can soak.

BRIEF SUMMARY OF THE INVENTION

The present invention provides a dishwasher basket for storing at least one valve of toddler training cups in a dishwasher for proper cleaning. The dishwasher basket is preferably composed of a top shell, a bottom shell and a pair of latching means. In one embodiment, the pair of latching means include two snap type latches to releasably connect the top and the bottom shells together at two opposing parts of the peripheries thereof. Alternatively, the pair of latching means includes a hinging structure to permanently hinge one part of the peripheries of the top and the bottom shells, and a snap type latch at the opposing part of the peripheries, such that the dishwasher basket may selectively open for loading and unloading the valve, and close for securely maintaining the valve therein through the dishwasher cycle. The top shell and the bottom shell are substantially symmetrical to each other and preferably formed in cylindrical or semi-spherical shape.

In one aspect of the present invention, the dishwasher basket includes a plurality of dividers protruding inwardly from the top and bottom shells to define a central area and a storage area about the central area. Also, the dishwasher basket may include a plurality of partitioning walls to partition the storage area into a plurality of compartments. The walls thereby inhibit valves from moving between compartments. Thus, the walls allow for increased cleaning capability.

The dishwasher basket is preferably attached to a top rack of the dishwasher vertically above the water jet source by a basket attachment, such that complete cleaning is enhanced by the water stream pressure generated by the water jet. The basket attachment comprises an attaching means or mount for attaching to the top rack of the dishwasher, a pedestal or prong engaged with the center of the bottom shell, and an arm extending between the mount and the pedestal. Preferably, the pedestal is snapped in a center aperture of the bottom shell, and the mount comprises a clamp, a clip or a hook selectively engageable with the dishwasher rack. The arm preferably has a length no shorter than the radius of the dishwasher basket. Therefore, during washing cycle of the dishwasher, the dishwasher basket may wobble about and partially or completely axially rotate above the central axis of the pedestal to vary the attack angle of the water jet contacting the valves contained therein and further improve the washing effect of the valves. In one aspect of the present invention, the dishwasher basket includes fins that extend outwardly from the bottom shell. These fins increase the exposed external surface area of the dishwasher basket so that the water jet is more likely to hit the dishwasher basket 20 and make it wobble for more effective cleaning.

In another aspect of the present invention is a container suitable for holding a soaking fluid as well as a training cup valve dishwasher basket. The container has an aperture at its top end through which the training cup valve dishwasher basket can be positioned into the container. In one embodiment, the container also has at least one suction cup attached to its bottom surface useful for releasably attaching the container to a counter top or similar surface. Moreover, in one embodiment, the container includes a lid that can be attached at the top end to substantially cover the aperture, to thereby reduce spillage of the soaking fluid. The container allows the valves to soak before being washed in the dishwasher, and this pre-soak facilitates the subsequent cleansing of the valves.

In one embodiment, the container is sold with the dishwasher basket. In this regard, one aspect of the present invention is a valve cleaning system that includes two dishwasher baskets, one basket attachment, and one container. As such, one dishwasher basket can be placed inside a dishwasher to clean valves while another dishwasher basket can soak inside the container, thereby adding convenience to the valve cleaning process.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
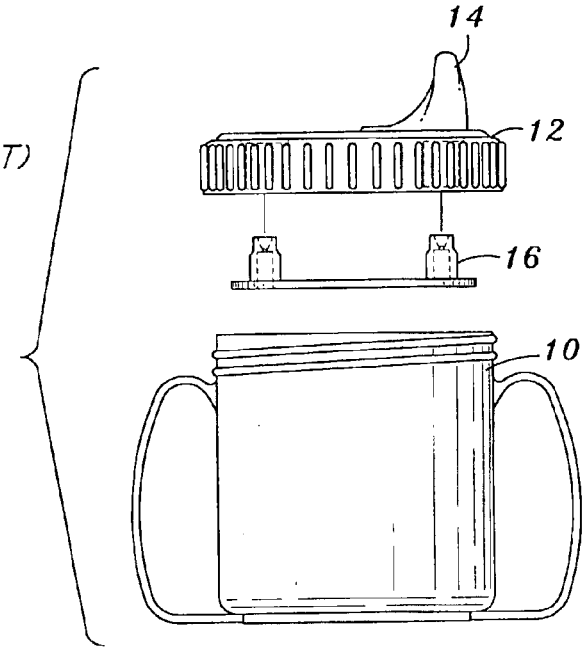
Fig. 1 (PRIOR ART)
FIG. 1 shows an exploded view of a prior art toddler training cup.
Figure 2:
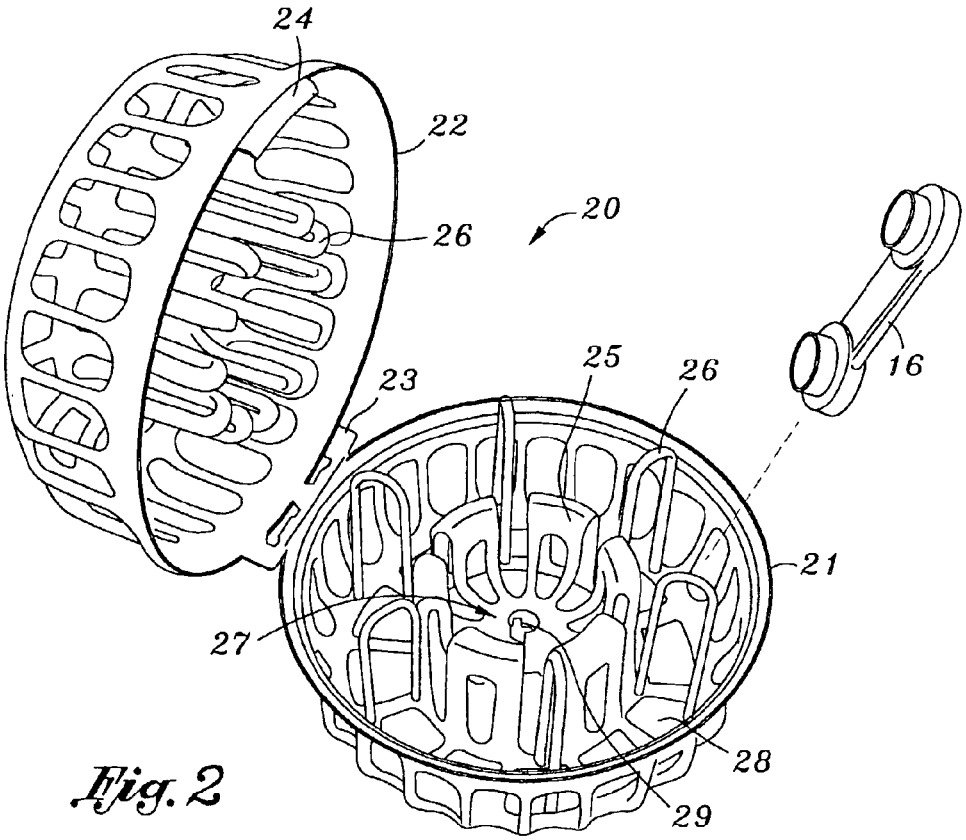
FIG. 2 illustrates a dishwasher basket for holding valves of toddler training cups according to the present invention depicted in an open configuration.

FIG. 2 illustrates a dishwasher basket 20 provided by the present invention. The dishwasher basket 20 includes two substantially symmetrical hollow shells 21, 22 formed in a substantially semi-spherical or cylindrical shape. The dishwasher basket 20 is made of heat-resistant material, including heat-resistant polymer/plastic. Both of the shells 21 and 22 have a plurality of openings such that water can flow through and clean the articles stored in the dishwasher basket 20. At one part of the peripheries, the shells 21 and 22 are connected to each other, preferably, permanently hinged to each other. At an opposing part of peripheries of the shell 21 and 22, a latching means 24, preferably snap type latch, is formed allowing the basket 20 to open for loading/unloading one or more valve 16, and be closed after the valves 16 are loaded/unloaded. Alternatively, the shells 21 and 22 can also connected by a pair of latching means, such as snap type latches to allow the basket 20 to partially open, or a complete separation of the shells 21 and 22 for loading/unloading the valves 16. In another embodiment, the shells 21 and 22 are partially threaded, and the shell 21 can screw onto and off of the other shell 22.

The dishwasher basket 20 further comprises a plurality of dividers 25 protruding inwardly from the shells 21, 22 to define a central area 27, and a storage area 28 of the valve 16 about the central area 27. In the storage area 28, each of the shells 21, 22 further comprises a plurality of partition elements 26 to partition the storage area 28 into a plurality of compartments. The partitioning elements 26 comprise a plurality of wire frames protruding inwardly from the shells 21, 22. For example, n-shaped wire frames are formed as the partitioning elements 26 in this embodiment. Therefore, each of the valves 16 is disposed in a specific compartment without moving to the other compartment. Therefore, the adverse cleaning effect caused by crowding the valves 16 together is avoided.

Figure 3:
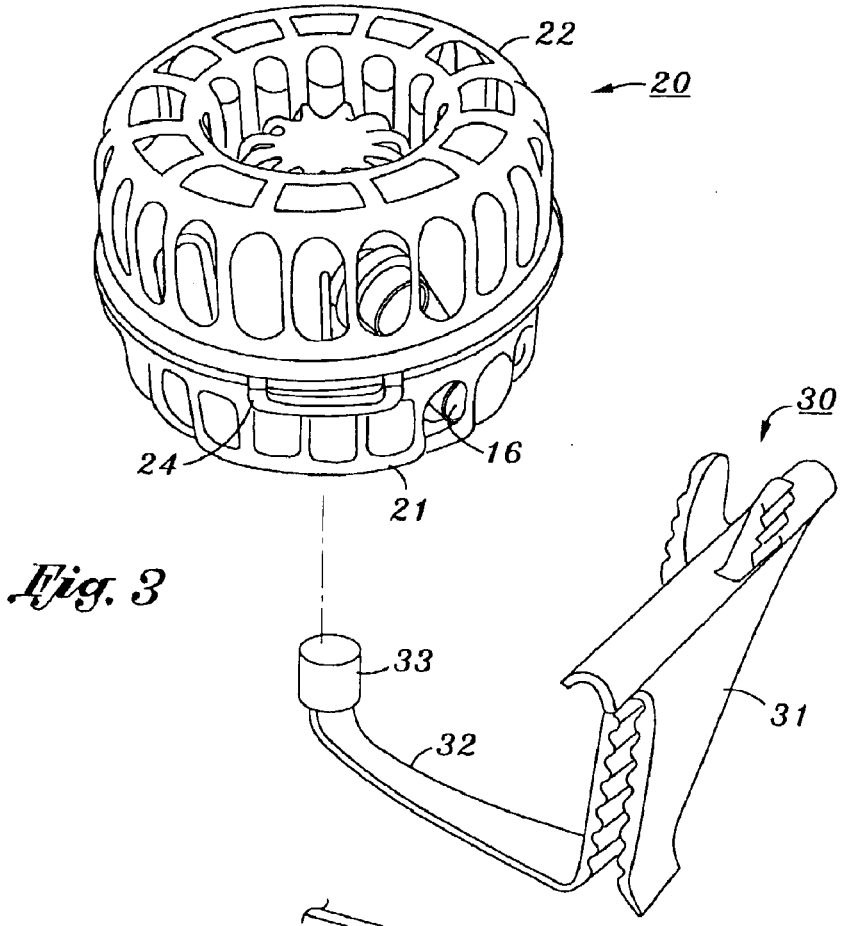
FIG. 3 is an exploded view of a dishwasher basket in a closed configuration holding a valve of toddler training cup therein and a hook for attaching the dishwasher basket to a rack of a dishwasher according to the present invention.
Figure 4:
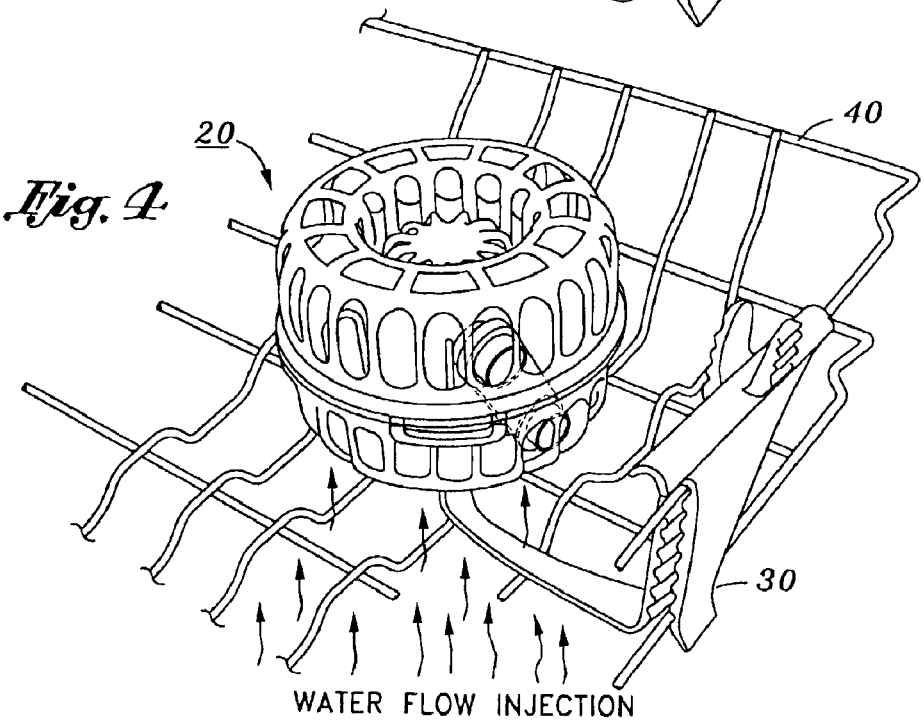
FIG. 4 shows a dishwasher basket attached to a rack of a dishwasher by means of a hook, and illustrates the water flow of the dishwasher according to the present invention.

Referring to FIGS. 2 and 3, the shells 21 and 22 are indented at the central area 27. At the indented central area 27, an aperture 29 is formed at the center of at least one of the shells 21 and 22 to provide proper attachment to the rack of the dishwasher (as shown in FIG. 2). Referring to FIGS. 3 and 4, a basket attachment 30 is used to attach the dishwasher basket 20 to a rack of the dishwasher. In FIG. 3, The dishwasher basket 20 is closed and a valve 16 is stored therein. The basket attachment 30 comprises a rack mount 31, an arm 32 extending from the rack mount 31, and a pedestal 33 at the end of the arm 32. In this embodiment, the rack attachment means 31 includes a clamp, a clasp or a clip. It will be appreciated that other mount such as a hook, a snap-type latch and the like can also be used to provide the similar attaching effect. The pedestal 33 is inserted, preferably snapped into the aperture 29 to firmly engage with the dishwasher basket 20 at the central axis thereof. Preferably, the arm 32 has a length no less than the distance between the periphery to the center of the dishwasher basket 20, that is, the radius of the dishwasher basket 20.

The dishwasher basket 20 can be attached at any rack at any desired position of the dishwasher to obtain a water stream injected to the valve 16 in a specific direction. For example, the basket 20 can be horizontally aligned with the water jet to provide a water stream vertically injected toward the valves 16. Preferably, the dishwasher basket 20 is placed in the top shelf or rack and aligned over the water jet source in a dishwasher. In FIG. 4, a valve 16 is stored in the dishwasher basket 20, and the dishwasher basket 20 is attached to the top rack 40 of the dishwasher by the basket attachment 30. During cleaning cycle, the valve 16 is washed by the water flow injection indicated by the arrows. The pressure generated by the water flow injection from various directions is thus applied to various parts of the valve to result in thorough cleaning.

Figure 5:
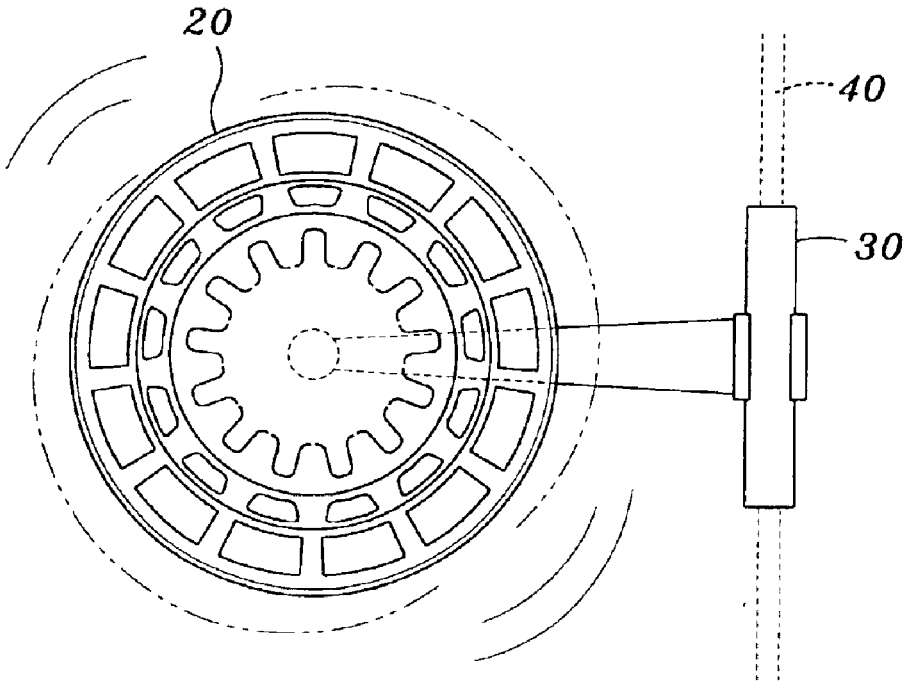
FIG. 5 shows a top view of a dishwasher basket disposed in a dishwasher during a cleaning cycle illustrating the movement of the basket relative to the water jet.
Figure 6:
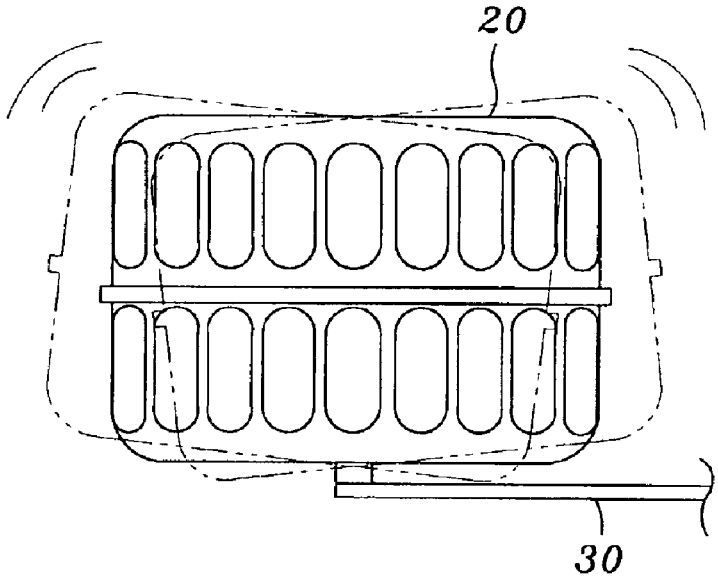
FIG. 6 shows a side view of a dishwasher basket disposed in a dishwasher during a cleaning cycle illustrating the movement of the basket.

As mentioned above, the dishwasher basket 20 is supported by the basket attachment 30 at the center 29 of the bottom shell 21. Therefore, the dishwasher basket 20 can wobble, bounce, shake, gyrate and partially or completely rotate about the central axis during the washing cycle. The movement of the dishwasher basket 20 is shown in FIGS. 5 and 6. In FIG. 5, the horizontal movement is illustrated, while in FIG. 6, the vertical movement is shown. The movement and orientation of the valves varies the attack of angle of the water jet injection relative to the valves, such that cleaning effect is further improved.

Although FIGS. 3–6 show the basket attachment 30 attached to a horizontal member of the top rack 40 of the dishwasher, it is appreciated that one skilled in the art could clip the basket attachment 30 to a vertical or diagonal member of the top rack 40 without departing from the spirit of the invention. Such an attachment allows the dishwasher basket 20 to be positioned in a wider variety of orientations for more effective cleaning.

Figure 7:
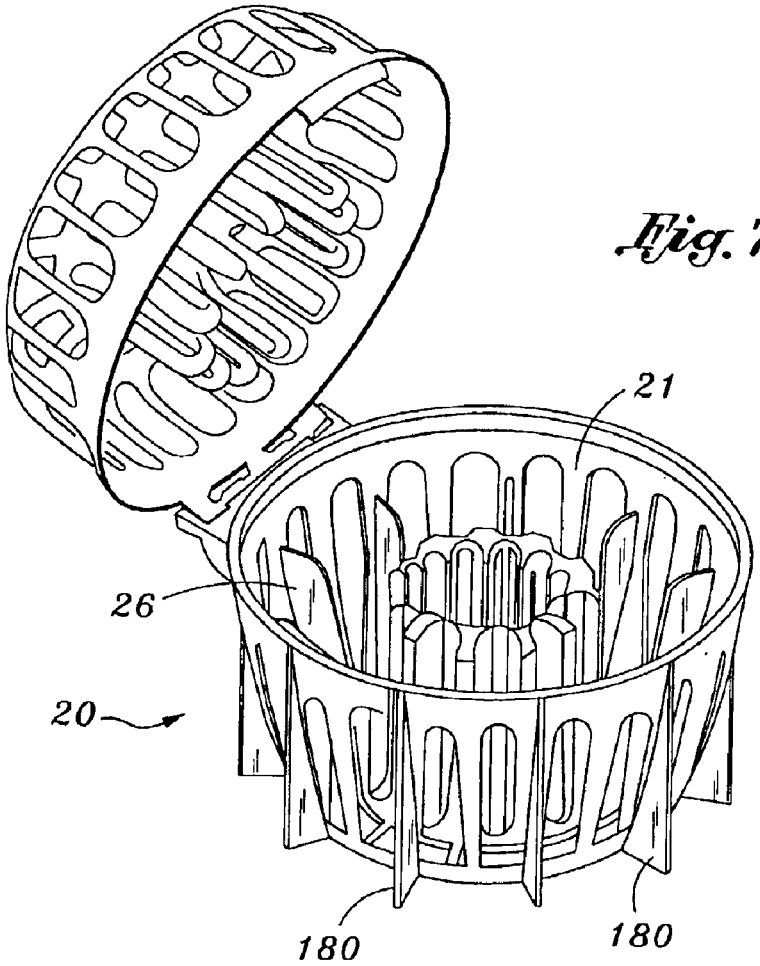
FIG. 7 shows a perspective view of another embodiment of a dishwasher basket suitable for holding valves of toddler training cups according to the present invention depicted in an open configuration.

Turning now to FIG. 7, an alternative embodiment of the dishwasher basket 20 is depicted. The dishwasher basket 20 illustrated is substantially similar to the dishwasher basket 20 illustrated in FIGS. 2–6; however, the dishwasher basket 20 of FIG. 7 includes fins 180. The typical fin 180 comprises a thin, triangularly shaped protrusion extending outward and normal from the shell 21. The fins 180 are preferably spaced evenly around the circumference of the shell 21. The fins 180 collectively increase the exposed external surface area of the dishwasher basket 20. By increasing the external surface area, the fins 180 provide more surface for dishwasher sprays to contact, thereby causing more rotation, shaking, and wobble of the dishwashing basket 20 during the dishwasher cycle. Thus, the fins 180 advantageously allow for more effective cleaning of the valves 16.

Moreover, the dishwasher basket 20 of FIG. 7 includes partition elements 26 that are similar to the partition elements 26 of FIGS. 2–6. However, the partition elements 26 of FIG. 7 are formed as solid walls. In the embodiment shown, each partition element 26 extends inward and normal from the shell 21, and the partition elements 26 are spaced according to the spacing of the fins 180 described hereinabove. Valves 16 loaded into the dishwasher basket 20 of FIG. 7 are likely to remain in place because of the solid wall configuration of the partition elements 26. Thus, the valves 16 are more likely to remain separated for more effective cleansing.

Figure 8:
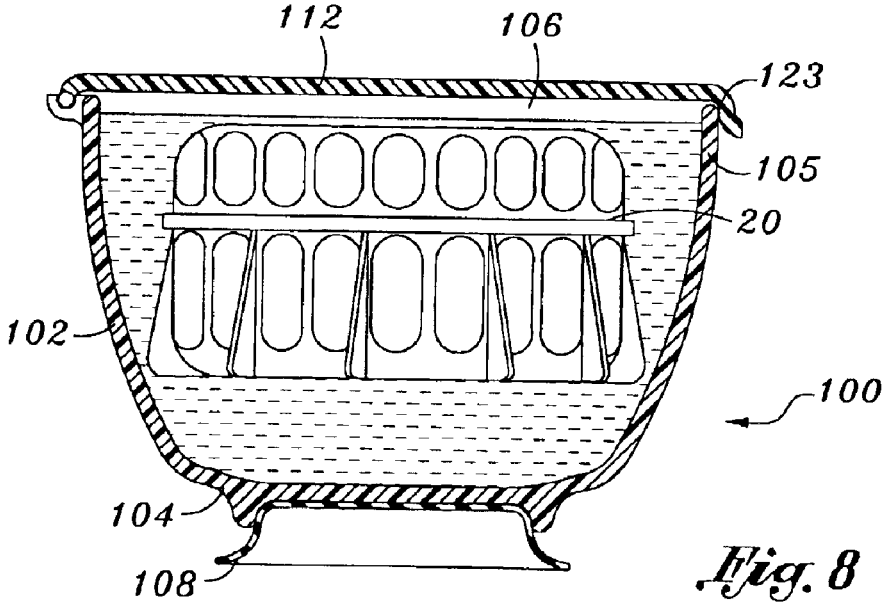
FIG. 8 shows a section view of a soaking container suitable for holding the dishwasher baskets shown in FIGS. 2–7.

Turning now to FIG. 8, a soaking container 100 is shown. In the embodiment shown, the soaking container 100 is hollow and semi-spherical so as to define a shell 102 with a relatively flat bottom side 104. The soaking container 100 also includes an opening 106 at a top end 105 which is preferably large enough to allow the dishwasher basket 20 to fit therethrough. Also in the preferred embodiment, the shell 102 is taller than the dishwashing basket 20. Furthermore, the shell 102 preferably is able to hold a soaking fluid (not shown), such as a water and soap solution.

Thus, a user can load dirty valves 16 into the dishwashing basket 20, and then soak the same in the soaking container 100. Preferably, the dishwashing basket 20 is fully immersed by the soaking fluid to increase cleaning effectiveness. As such, the dirty valves 16 remain moist and are unlikely to dry out and form caked-on deposits of dried milk, juice, or other liquid on the valve 16. Similarly, dirty valves 16 that have dried out also benefit from such soaking because the soaking loosens the deposits formed when the valve 16 dried out. In either case, the valves 16 can be cleaned more easily when the dishwashing basket 20 is pre-soaked in the soaking container 100.

In one embodiment, a suction cup 108 is attached to the bottom side 104 of the soaking container 100. The suction cup 108 is widely known in the art for being able to removably attach to flat surfaces. Thus, the suction cup 108 can be used to anchor the soaking container 100 to a counter top or like surface, and since many counter tops often get wet, the suction cup 108 inhibits the soaking container 100 from otherwise sliding or falling off of the slippery counter top. It is understood that multiple suction cups 108 could be used in another embodiment, without departing from the spirit of invention.

Moreover, in the embodiment shown, the soaking container 100 comprises a lid 112. The lid 112 is flat and approximately the same shape and size as the opening 106. The lid 112 is hingedly attached to the top end 105, and as such, the lid 112 can cover the opening 106 and prevent foreign particles from entering the soaking solution. Furthermore, in another embodiment, the lid 112 includes a clasp 123, and once clasped, the lid 112 seals soaking solution inside the soaking container 100 to thereby reduce spillage.

In one embodiment, the soaking container 100 is sold with the dishwasher basket 20. In the preferred embodiment, the soaking container 100 is sold with two dishwasher baskets 20 and the basket attachment 30. As such, one dishwasher basket 20 can soak in the soaking container 100 while the other dishwasher basket 20 is inside the dishwasher, thereby adding convenience to the valve cleaning process.

Indeed, each of the features and embodiments described herein can be used by itself, or in combination with one or more of other features and embodiment. Thus, the invention is not limited by the illustrated embodiment but is to be defined by the following claims when read in the broadest reasonable manner to preserve the validity of the claims.

What is claimed is:

1. A dishwasher basket for storing at least one valve of toddler training cups, comprising:

a top shell, having a plurality of openings;

a bottom shell releasably attached to the top shell, the bottom shell having a plurality of openings;

a plurality of dividers protruding inwardly from the top and bottom shells to define a central area and a storage area about the central area; and a plurality of partitioning walls to partition the storage area into a plurality of compartments;

wherein the top shell and the bottom shell are substantially symmetrical to each other.

2. The dishwasher basket according to claim 1, further comprising a container suitable for holding a soaking fluid as well as the dishwasher basket.

3. A dishwasher basket for storing at least one valve of toddler training cups, comprising:

a top shell, having a plurality of openings;

a bottom shell releasably attached to the top shell, the bottom shell having a plurality of openings; and a plurality of fins extending outwardly from the bottom shell;

wherein the top shell and the bottom shell are substantially symmetrical to each other.

4. The dishwasher basket according to claim 3, further comprising a container suitable for holding a soaking fluid as well as the dishwasher basket.

* * * * *